US007452228B1

(12) United States Patent
Kennedy et al.

(10) Patent No.: US 7,452,228 B1
(45) Date of Patent: Nov. 18, 2008

(54) BNC PLUG CONNECTOR WITH ROTATIONAL POSITION INDICATION AND ASSOCIATED METHOD

(76) Inventors: James P. Kennedy, 2682 Oakburst Dr., Rock Hill, SC (US) 29732; Randall Higgason, 3201 Horseshoe Trail, Fort Mill, SC (US) 29708

( * ) Notice: Subject to any disclaimer, the term of this patent is extended or adjusted under 35 U.S.C. 154(b) by 0 days.

(21) Appl. No.: 11/761,685

(22) Filed: Jun. 12, 2007

(51) Int. Cl.
*H01R 13/62* (2006.01)

(52) U.S. Cl. ..... 439/315; 439/314

(58) Field of Classification Search ..... 439/488, 439/491, 314, 315, 489
See application file for complete search history.

(56) References Cited

U.S. PATENT DOCUMENTS

| | | | |
|---|---|---|---|
| 3,609,632 | A | 9/1971 | Vetter |
| 3,708,781 | A | 1/1973 | Trompeter |
| 3,790,915 | A | 2/1974 | Dugan et al. |
| 3,801,954 | A | 4/1974 | Dorrell |
| 3,808,580 | A | 4/1974 | Johnson |
| 3,947,081 | A | 3/1976 | Peterson |
| 3,960,428 | A | 6/1976 | Naus et al. |
| 4,037,909 | A | 7/1977 | Trompeter et al. |
| 4,059,324 | A | 11/1977 | Snyder et al. |
| 4,289,368 | A | 9/1981 | Schildkraut |
| 4,290,662 | A | 9/1981 | Storcel |
| 4,373,770 | A | 2/1983 | Raux et al. |
| 4,462,653 | A | 7/1984 | Flederbach et al. |
| 4,534,607 | A | 8/1985 | Tomsa |
| 4,645,281 | A | 2/1987 | Burger |
| 4,674,809 | A | 6/1987 | Hollyday et al. |
| 4,702,537 | A | 10/1987 | Mattingly et al. |
| 4,703,988 | A | 11/1987 | Raux et al. |
| 4,781,619 | A | 11/1988 | Ikeda |
| 5,067,909 | A | 11/1991 | Behning |
| 5,280,254 | A | 1/1994 | Hunter et al. |
| 5,382,173 | A | 1/1995 | Brown et al. |

(Continued)

FOREIGN PATENT DOCUMENTS

| | | |
|---|---|---|
| GB | 2 313 207 | 11/1997 |
| WO | WO 02/073223 | 9/2002 |

*Primary Examiner*—Tho D Ta
(74) *Attorney, Agent, or Firm*—Rothwell, Figg, Ernst & Manbeck

(57) ABSTRACT

There is provided a BNC plug connector and associated method for engaging a BNC jack member and indicating a rotational position of the plug connector. The plug connector generally includes a sleeve that defines a first aperture at a first end for receiving a jack member and a second aperture at the second end. A plug member is disposed in the sleeve and configured to engage the jack member, which can be inserted through the aperture at the first end of the sleeve. A contrast surface at the second end of the sleeve defines a contrast surface such as a surface of a washer that is visible through a second aperture at the second end of the sleeve. One or more features, such as tabs, defined at the second end of the sleeve extend radially inward at the second end to a radial position that is coincident with the contrast member. Each feature defines a color that is dissimilar to the contrast surface so that the position of the feature is easily visible from the second end of the sleeve, and the rotational position of the sleeve can be determined by the feature.

20 Claims, 5 Drawing Sheets

U.S. PATENT DOCUMENTS

| | | | |
|---|---|---|---|
| 5,409,398 | A | 4/1995 | Chadbourne et al. |
| 5,417,588 | A | 5/1995 | Olson et al. |
| 5,430,615 | A | 7/1995 | Keeth et al. |
| 5,490,033 | A | 2/1996 | Cronin |
| 5,547,395 | A | 8/1996 | Delamotte |
| 5,662,488 | A | 9/1997 | Alden |
| 5,695,365 | A | 12/1997 | Kennedy et al. |
| 5,702,262 | A | 12/1997 | Brown et al. |
| 5,860,833 | A | 1/1999 | Chillscyzn et al. |
| 5,897,384 | A | 4/1999 | Hosler, Sr. |
| 6,045,378 | A | 4/2000 | Follingstad |
| 6,106,314 | A | 8/2000 | McLean et al. |
| 6,162,082 | A | 12/2000 | Karsten et al. |
| 6,174,206 | B1 | 1/2001 | Yentile et al. |
| 6,226,068 | B1 | 5/2001 | Arcykiewicz et al. |
| 6,305,963 | B1 | 10/2001 | Felps |
| 6,390,825 | B1 | 5/2002 | Handley et al. |
| 6,561,841 | B2 | 5/2003 | Norwood et al. |
| 6,676,439 | B2 | 1/2004 | Litwiller |
| 6,679,728 | B1 | 1/2004 | Huang et al. |
| 6,783,382 | B2 | 8/2004 | Felps |
| 6,811,423 | B2 | 11/2004 | Yoshigi et al. |
| 6,921,283 | B2 | 7/2005 | Zahlit et al. |
| 6,977,595 | B2 | 12/2005 | Litwiller et al. |
| 7,081,001 | B1 | 7/2006 | Conroy et al. |
| 7,104,826 | B2 | 9/2006 | Zahlit et al. |
| 7,153,153 | B1 | 12/2006 | Conroy et al. |
| 7,182,628 | B2 * | 2/2007 | Holliday ..... 439/491 |
| 2003/0129870 | A1 | 7/2003 | Norwood et al. |
| 2004/0038584 | A1 | 2/2004 | Zahlit et al. |
| 2004/0203283 | A1 | 10/2004 | Chen et al. |

* cited by examiner

BNC PLUG CONNECTOR WITH ROTATIONAL POSITION INDICATION AND ASSOCIATED METHOD

BACKGROUND OF THE INVENTION

1) Field of the Invention

The present invention relates to an electrical connector and, more particularly, to a BNC connector with one or more features that indicate the rotational position of the connector and thereby indicate whether the connector is engaged to a corresponding jack member.

2) Description of Related Art

Bayonet Neill-Councelman (BNC) connectors are widely used, e.g., for connecting analog or digital video equipment that communicate via coaxial cables. A conventional BNC connection includes mating jack and plug connectors. Each connector can be connected to coaxial wires or other contact elements so that the wires or other contacts are electrically connected when the two connectors are engaged. The connectors are configured to be secured in the engaged position by the mating of corresponding bayonets and slots on the two connectors. For example, a conventional BNC jack connector typically defines two bayonets or posts that extend radially outward from a barrel-shaped connection member, and a conventional BNC plug connector typically includes a sleeve that defines two slots for receiving the posts. Each slot includes a first portion that extends longitudinally from a first end of the sleeve and a second portion that extends from the first portion at an angle thereto, such that the second portion of the slot extends in a direction with both longitudinal and circumferential components. Thus, each post is advanced through the first portion of a respective slot as the connectors are advanced towards each other, and then the sleeve is rotated relative to the jack connector so that each post is advanced through the second portion of the respective slot. Each post can be retained in a detent at the end of the second portion of the slot.

In some cases, one of the connectors is fixed to a panel or bulkhead, and the other connector is selectively connected or disconnected. For example, a plurality of jack connectors can be fixed to a panel, and the jack connectors can provide connections to electrical equipment. Cables with plug connectors can be connected to the jack connectors or disconnected therefrom to selectively connect the cables to the jack connectors and, hence, the electrical equipment. Many jack connectors can be provided on a single panel, and the connectors may be situated in close proximity to one another, such that a user cannot easily view the sides of the connectors to determine if the posts are fully advanced into the slots and the connectors are engaged.

Some conventional connectors have physical features for visually indicating when connectors are fully engaged. For example, U.S. Pat. No. 6,561,841 discloses a plug-side connector with a sleeve that has an indicator that aligns with a reference point when the sleeve is fully engaged with a jack-side connector. The indicator can be a substantially V-shaped notch, a dimple, a ridge, or a lug. In some cases, however, such features can be difficult to see. For example, when viewed in a tightly packed configuration of connectors on a panel and/or in a low-light situation, a user may be unable to visually discern the notch, dimple, ridge, or lug and, therefore, unable to identify whether the connection is fully engaged.

Thus, there exists a need for an improved connector and method for indicating a rotational position so that a user can more easily identify whether a connection is fully engaged.

BRIEF SUMMARY OF THE INVENTION

According to one embodiment, the present invention provides a BNC plug connector for engaging a BNC jack member and indicating a rotational position of the plug connector. The rotational position is indicated by features, such as tabs, that extend radially inward to be visible adjacent a contrast surface of a dissimilar color so that the position of the features can be easily identified, even along a longitudinal direction when viewed from the back of the plug and even in low-light or other conditions of limited visibility.

The plug connector includes a sleeve that extends longitudinally between first and second ends. In one embodiment, the sleeve defines a first aperture at the first end for receiving a jack member, a second aperture at the second end, and two slots extending from the first end toward the second end and configured to receive radial posts extending radially from the jack member. A plug member is disposed in the sleeve and configured to engage the jack member. The contrast surface can be provided as a contrast member, such as a washer that is disposed in the sleeve at the second end. The contrast surface is visible from the second end of the sleeve, e.g., as a surface of the contrast member is visible through the second aperture, and the sleeve defines at least one feature at the second end extending radially inward to a radial position coincident with the contrast surface. For example, each feature can be a tab that extends radially inward into the aperture at the second end. Two of the features can be provided, each extending radially inward from positions on the sleeve that are disposed 180 degrees apart. Each feature defines a color that is dissimilar to the contrast surface so that the position of the feature is visible from the second end of the sleeve. The position of the feature is indicative of a rotational position of the sleeve.

For example, the contrast surface can be defined by a contrast member, such as a washer, that has first and second parallel sides and an aperture extending therethrough, the washer being at least partially retained in the sleeve by the feature(s). Each feature can be a tab that is formed as an integral part of the sleeve. Each tab or other feature can define a metal color, and the contrast surface can define a non-metal color, such as black, red, green, blue, yellow, purple, or orange. Further, each tab can define a first side and a second side, and the sleeve can define a relief cutout adjacent each side of each tab, with each tab defining a bend (e.g., a bend of approximately 90 degrees, or less) from which the tab extends radially inward between the relief cutouts. In one particular embodiment, the sleeve defines two of the tabs, and each relief cutout defines a continuously curved contour between the bend of a respective one of the tabs to a circumferential ridge of the sleeve extending between two of the relief cutouts.

Another embodiment of the invention provides a method of engaging a BNC plug connector to a BNC jack member and indicating a rotational position of the plug connector. The method includes inserting the jack member into a first end of a sleeve of the plug connector so that the jack member is engaged with a plug member disposed in the sleeve and radial posts of the jack member are disposed in slots extending from the first end of the sleeve toward an opposite second end of the sleeve. The sleeve is rotated relative to the jack member so that at least one feature, such as a tab, defined by the sleeve at the second end rotates relative to the jack member. Each feature defines a color dissimilar to a contrast surface so that the position of the feature is visible from the second end of the sleeve. The position of the feature is indicative of a rotational position of the sleeve relative to the jack member.

Two of the features can be provided on the sleeve, each feature extending radially inward from positions on the sleeve disposed 180 degrees apart. The contrast surface can be provided as a contrast member, such as a washer, that defines first and second parallel sides and an aperture extending therethrough, the washer being at least partially retained in the sleeve by the at least one feature. In some cases, the contrast surface is provided to define a non-metal color, such as black, red, green, blue, yellow, purple, or orange, and each feature defines a contrasting metal color. Each feature can be provided as a tab that is an integral part of the sleeve. Also, each tab can define a first side and a second side, and the sleeve can define a relief cutout adjacent each side of each tab, each tab defining a bend of approximately 90 degrees between the relief cutouts. The contrast surface can be defined by a member that is inserted into the sleeve from the second end of the sleeve and, thereafter, each tab can be bent into the aperture defined by the sleeve.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
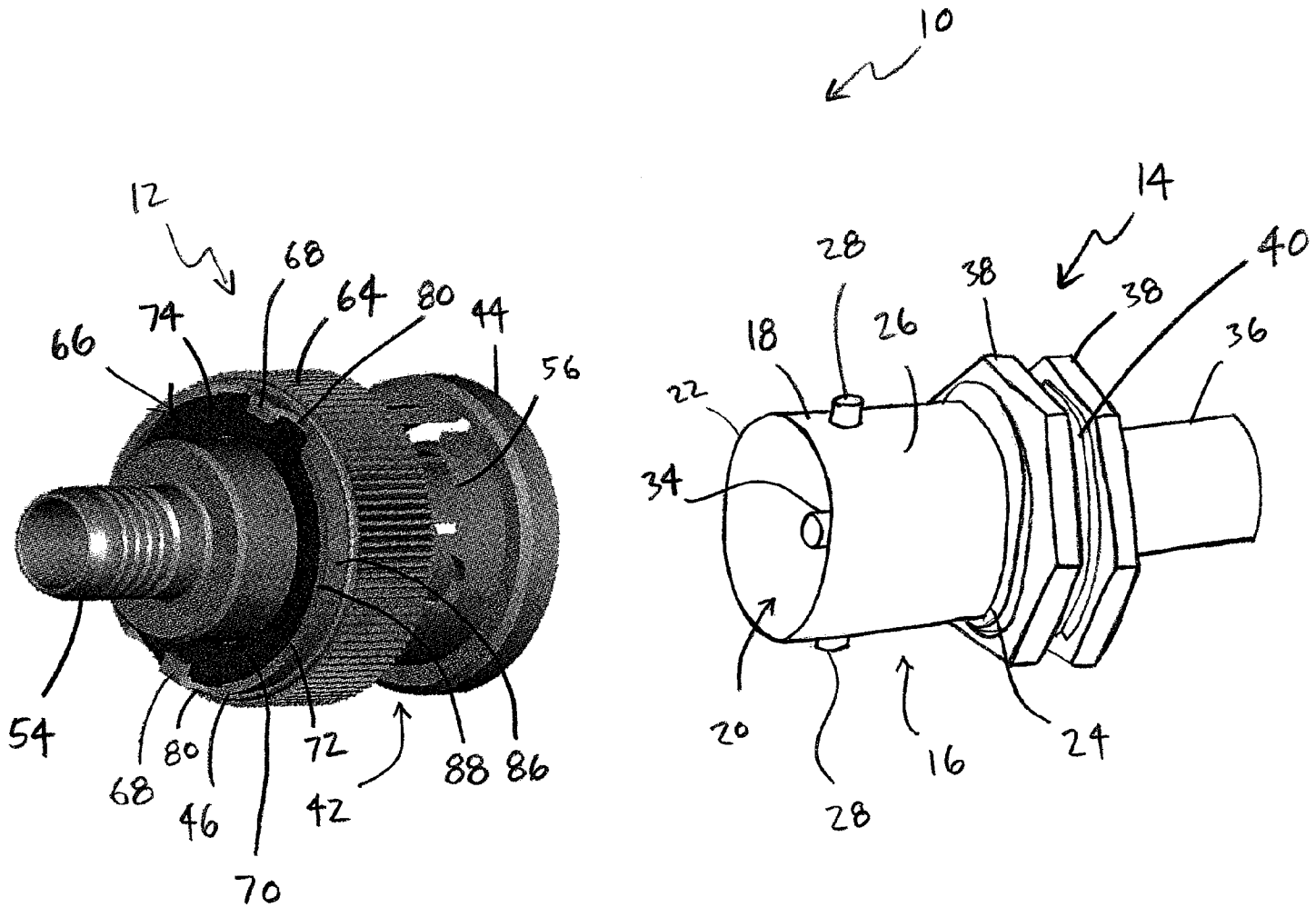
FIG. 1 is a perspective view illustrating a BNC plug connector and a corresponding BNC jack connector according to one embodiment of the present invention.

Referring now to the figures and, in particular, to FIG. 1, there is shown a connector assembly 10 that includes a BNC plug connector 12 and a corresponding BNC jack connector 14 that are configured to be engaged with one another according to one embodiment of the present invention. The connectors 12, 14 can be used in many different applications, and are typically used to selectively connect electrical equipment. In this regard, each connector 12, 14 can be fixedly connected to a coaxial cable or other electrical line that provides a connection between the respective connector 12, 14 and an electrical device. That is, the plug connector 12 can be attached by a first cable to a first electrical device, and the jack connector 14 can be attached by a second cable to a second electrical device so that, when the two connectors 12, 14 are engaged, the first and second electrical devices are electrically connected via the cables and connectors 12, 14.

The jack connector 14, which can be a conventional BNC connection device, defines a longitudinally extending jack member 16 that includes a cylindrical, sleeve-like outer body 18 and an inner body disposed therein. The outer body 18 extends between first and second ends 22, 24 and defines an outer surface 26 with two posts 28 that extend radially therefrom. The inner body is a cylindrical female socket 34 disposed in a space 20 defined by the sleeve-like outer body 18. The cylindrical outer body 18 and the female socket 34 are typically electrically isolated from one another, for example, by an insulator that is disposed between the outer surface of the female socket 34 and the inner surface of outer body 18 of the jack member 16. The outer body 18 and the female socket 34 member can be connected to separate electrical conductors in a coaxial cable, the end of which is inserted through a tubular portion 36 of the connector at the second end 24 of the outer body 18. Removable and/or adjustable mechanical connectors can be provided on the outer body 18 so that the jack connector 14 can be secured to a panel or other structure. For example, as illustrated, two adjustable nuts 38 can be disposed on a threaded portion 40 of the jack connector 14 at the second end 24 of the outer body 18. With the two nuts 38 disposed on opposite sides of a planar panel (FIG. 8), the nuts 38 can be adjusted relatively toward one another to secure the jack connector 14 to the panel.

Figure 2:
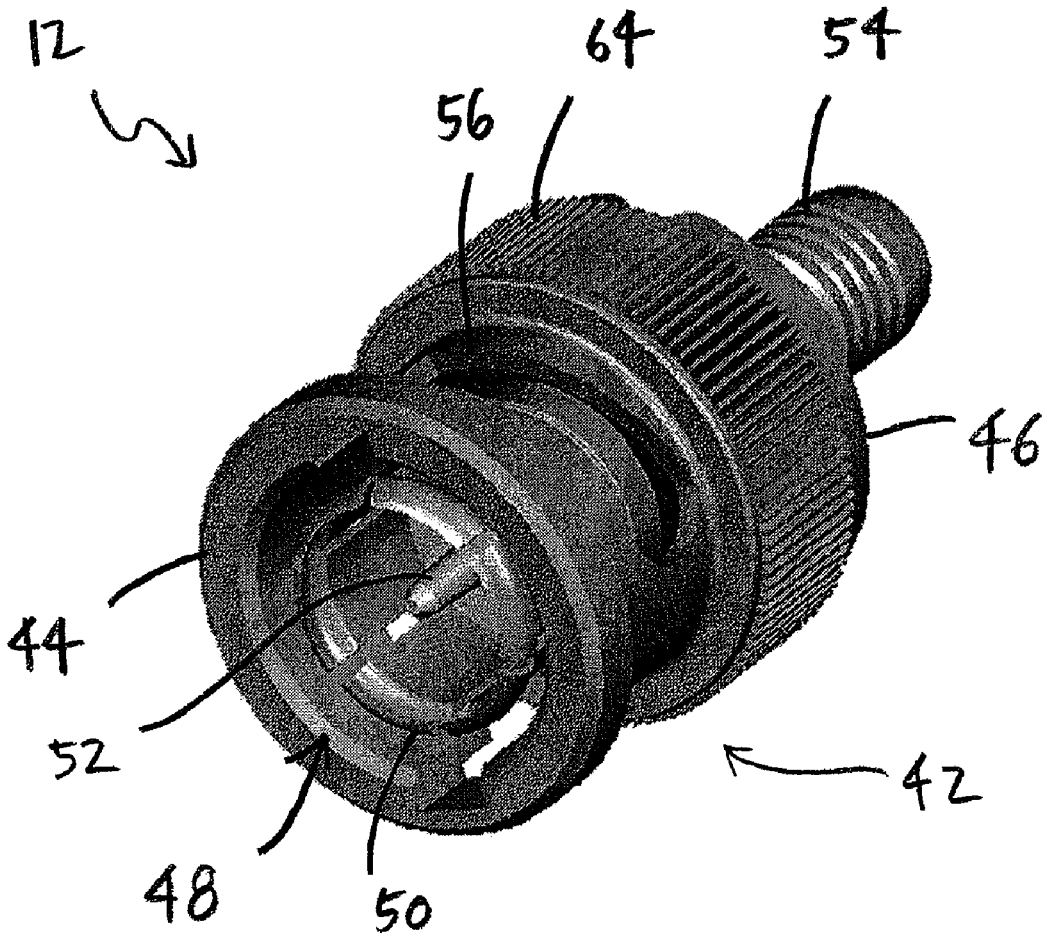
FIGS. 2 and 3 are perspective views illustrating the BNC plug connector of FIG. 1.
Figure 3:
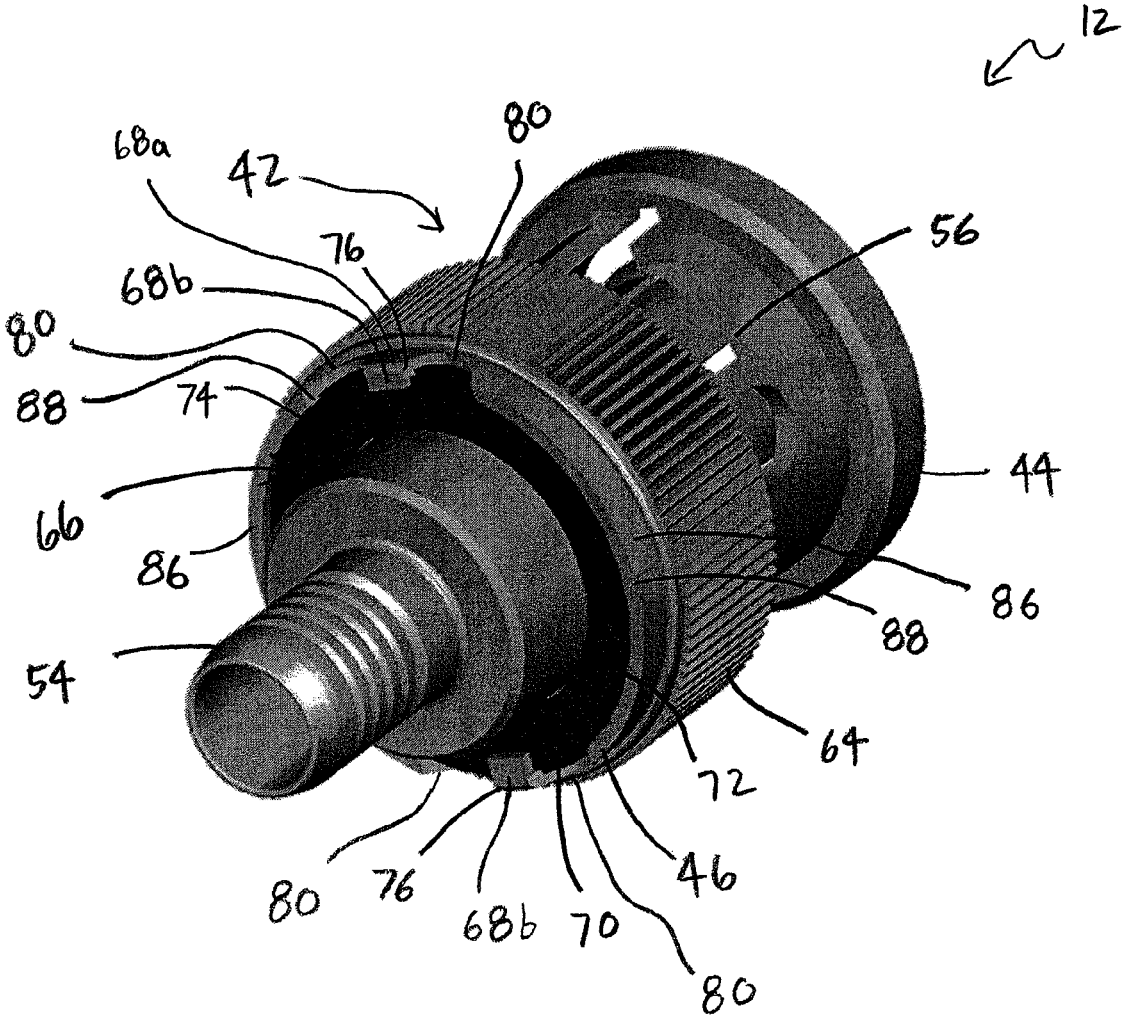

The plug connector 12, shown individually in FIGS. 2 and 3, is configured to mechanically and electrically engage the jack connector 14. In particular, the plug connector 12 includes a sleeve 42 that extends longitudinally between first and second ends 44, 46 and defines a first aperture 48 at the first end 44 for receiving the jack member 16. As shown in FIG. 2, a plug member 50 disposed in the sleeve 42 is configured to receive the female socket 34 of the jack member 16 such that the outer surface of the plug member 50 contacts the inner surface of the cylindrical outer body 18 of the jack member 16. Further, a male probe connector 52 disposed in a cavity defined by the plug member 50 is configured to extend into the female socket 34 of the jack member 16. The plug member 50 and the male probe connector 52 can be connected to separate electrical conductors in a coaxial cable, the end of which is inserted through a tubular portion 54 of the plug connector 12 at the second end 46 of the sleeve 42. The tubular portion 54 can be formed integrally with the plug member 50. When the plug connector 12 and jack connector 14 are engaged, the electrical conductors of the two coaxial cables provide two separate electrical connections by virtue of the contact of the inner surface of the outer body 18 of the jack member 16 with the outer surface of the plug member 50 and the contact of the inner surface of the female socket 34 with the outer surface of the cylindrical male contact member 52.

The plug and jack connectors 12, 14 can have other configurations in other embodiments. For example, a device similar to the inner body 20 of the jack member 16 (instead of the plug member 50) can be disposed in the sleeve 42, and a device similar to the plug member 50 (instead of the inner body 20) can be disposed in the outer body 18 of the jack member 16.

Figure 7:
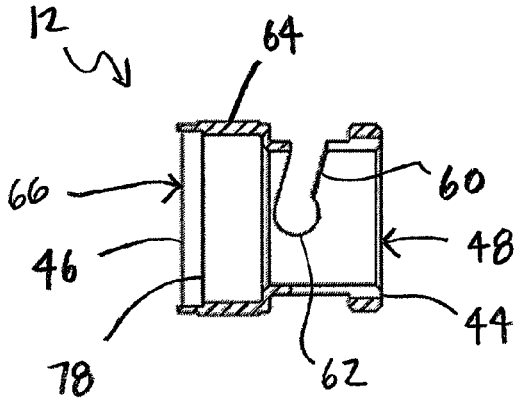
FIG. 7 is a section view of the sleeve of FIG. 4, as seen along line 7-7 of FIG. 6.
Figure 6:
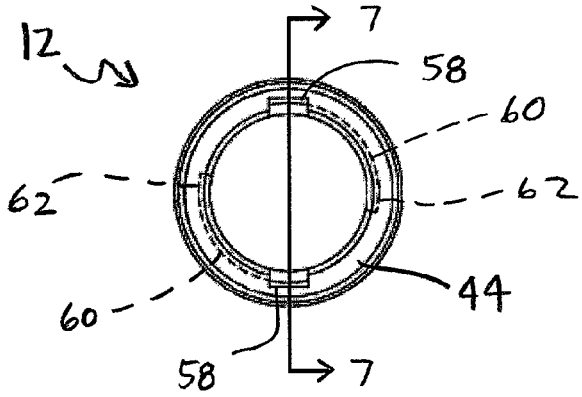
FIG. 6 is an elevation view illustrating a first end of the sleeve of FIG. 4.
Figure 4:
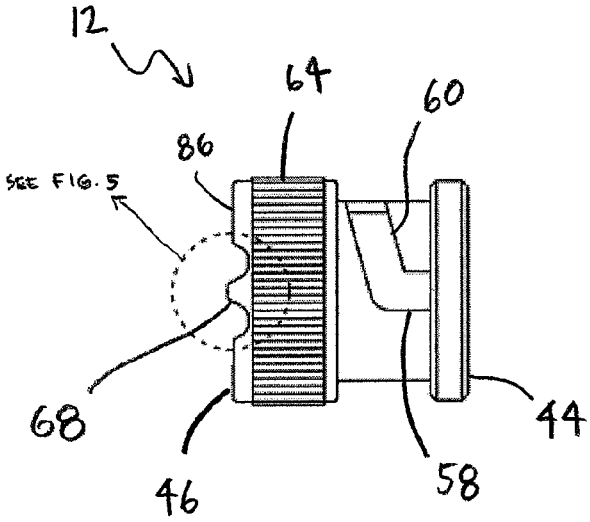
FIG. 4 is an elevation view illustrating the sleeve of the BNC plug connector of FIG. 1, having two tabs shown in an unbent configuration.

The sleeve 42 defines two slots 56 extending from the first end 44 toward the second end 46, each slot 56 being configured to receive one of the radial posts 28 of the jack member 16. As shown in FIGS. 4, 6, and 7, each slot 56 typically defines a first portion 58 that extends longitudinally from the first end 44 of the sleeve 42 and a second portion 60 that extends from the first portion 58 at an angle thereto so that the second portion 60 of the slot 56 extends in a direction with both longitudinal and circumferential components. Thus, as the jack member 16 is advanced into the plug connector 12, each post 28 is advanced through the first portion 58 of a respective one of the slots 56. The sleeve 42 can then be rotated relative to the jack member 16 so that each post 28 is advanced through the second portion 60 of the respective slot 56 while the jack member 16 is further advanced into the plug connector 12. Each post 28 is retained in a detent 62 at the end of the second portion 60 of the respective slot 56. A grip portion 64 of the outer surface of the sleeve 42 can be knurled or otherwise contoured to facilitate gripping manually by a user or with a tool.

The plug connector 12 is also configured to indicate its rotational position relative to the jack connector 14. In particular, as shown in FIG. 3, the sleeve 42 defines an aperture 66 at its second end 46 and one or more features 68 that extend radially inward. In the illustrated embodiment, each feature is a tab 68 that extends radially inward into the aperture 66, though in other embodiments, the features 68 can be provided as other members, painted portions on the sleeve 42, other marks provided on the sleeve 42, or the like. A contrast member 70, such as a colored washer, is disposed in the sleeve 42, and each tab 68 extends radially inward to a radial position that is coincident with the contrast member 70. In the embodiment shown in FIG. 3, the contrast member 70 is a colored washer with first and second opposite, parallel sides and an aperture 72 extending therethrough. The contrast member 70 extends circumferentially around the plug member 50 and is disposed in the sleeve 42 so that a contrast surface 74 defined by the first side of the contrast member 70 is visible from the second end 46 of the sleeve 42 through the aperture 66. In the illustrated embodiment, the contrast surface 74 is defined by the member 70 that is separate from the sleeve 42; however, it is appreciated that the contrast surface 74 can alternatively be defined by other members or as a painted portion on the sleeve 42, other marks provided on the sleeve 42 or elsewhere on the connector 12, or the like. The sleeve 42 includes two tabs 68, and each tab 68 extends radially inward to a position that is radially coincident with the contrast member 70 so that each tab 68 overlaps the contrast member 70 and the color of each tab 68 is visibly disposed immediately adjacent the contrast member 70 when viewed from the second end 46 of the sleeve 42.

Each tab 68 (or other feature) defines a color that is dissimilar to the color of the contrast member 70 so that the position of the tab 68 is visible from the second end 46 of the sleeve 42. Thus, a person can easily discern the position of the tabs 68 by viewing the sleeve 42 from the second end 46 and, since the position of the tabs 68 is indicative of the rotational position of the sleeve 42, determine whether the sleeve 42 is fully engaged to the jack connector 14.

Figure 5:
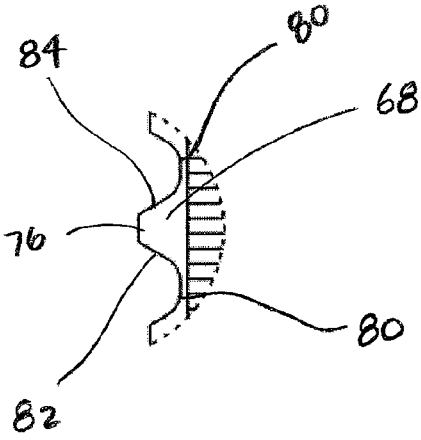
FIG. 5 is an enlarged view illustrating a portion of the sleeve of FIG. 4, as indicated in FIG. 4.
Figure 8:
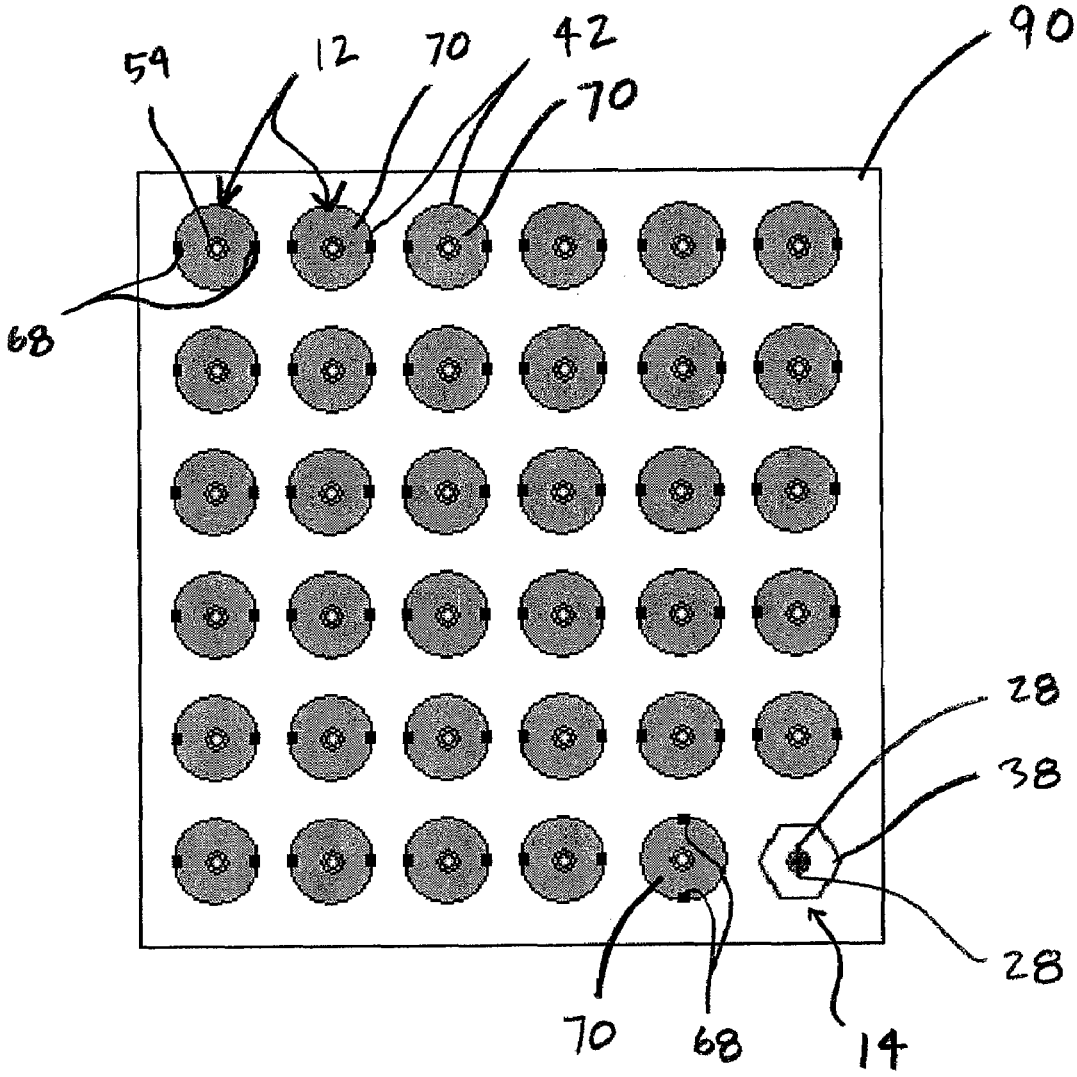
FIG. 8 is an elevation view illustrating an assembly including a plurality of BNC plug connectors according to one embodiment of the present invention, each of the plug connectors indicating a rotational position thereof.

In the illustrated embodiment, each feature 68 is a tab that is formed as an integral part of the sleeve 42 so that the sleeve 42 and tabs 68 are a single, unitary member. As shown in FIG. 3, each tab 68 can define a bend 76 or fold in the material of the sleeve 42. For example, each tab 68 can define a bend 76 of up to about 90 degrees (such as a bend of about 90 degrees, as shown in FIG. 3) so that a base portion 68*a* of the tab 68 is part of the circumferential portion of the sleeve 42 and a bent portion 68*b* of the tab 68 extends radially inward from the bend 76. The bend 76 can be formed integrally with the formation of the sleeve 42, e.g., by machining or casting the sleeve 42 with the tabs 68 in the desired configuration. Alternatively, the tab 68 can be bent after the sleeve 42 is machined, cast, or otherwise formed, i.e., by forming the sleeve 42 with the tabs 68 in a straight configuration (i.e., with the tabs unbent, as shown in FIGS. 4, 5, and 7) and subsequently bending each tab 68 to the desired configuration (as shown in FIGS. 1, 3, and 8). If the tabs 68 are to be bent after the formation of the sleeve 42, the contrast member 70 can be inserted into the sleeve 42 from the second end 46 of the sleeve 42 before bending the tabs 68 and the tabs 68 can then be bent with the contrast member 70 in the sleeve 42 so that the tabs 68 retain the sleeve 42 therein. A shoulder 78 (FIG. 7) defined in the sleeve 42 can also be configured to support the contrast member 70, e.g., so that the contrast member 70 is disposed and retained between the shoulder 78 and the tabs 68.

Relief cutouts 80 can be provided adjacent each tab 68. That is, as shown in FIG. 4, each tab 68 can define first and second edges or sides 82, 84 (FIG. 5) that are directed generally in the circumferential direction of the sleeve 42, and a relief cutout 80 can be provided adjacent each of the sides 82, 84 such that the bend 76 of each tab 68 is disposed between the cutouts 80. The relief cutouts 80 can extend from the second end 46 of the sleeve 42 in a direction toward the first end 44 such that a portion of the washer or other contrast member 70 is visible through the relief cutouts 80 when the sleeve 42 is viewed at an angle relative to the longitudinal (or axial) direction. As described above, when the sleeve 42 is viewed in the longitudinal direction, the tabs 68 provide an indication of the rotational position of the sleeve 42 and, hence, the plug connector 12. Similarly, when the sleeve 42 is viewed at an angle relative to the longitudinal direction (such as in the radial direction, perpendicular to the longitudinal direction), the relief cutouts 80 provide an indication of the rotational position of the sleeve 42 and the connector. In this way, the rotational position can easily be determined regardless of whether a person is viewing the sleeve 42 in the longitudinal direction or at an angle relative thereto.

A circumferential ridge 86 can be disposed between the relief cutouts 80 of the different tabs 68. As illustrated in FIG. 3, each ridge 86 can extend to a longitudinal position that is about the same as the longitudinal extension of the tab 68, and each relief cutout 80 can define a continuously curved contour between the bend 76 of a respective one of the tabs 68 to the circumferential ridge 86 of the sleeve 42 that extends to one of the relief cutouts 80 adjacent the other tab 68. In this way, the relief cutouts 80 (and each tab 68) can be easily distinguishable from the ridge 86. In some cases, the ridge 86 can also define a lip 88 that extends radially inward, e.g., to support and retain the contrast member 70 in the sleeve 42. The radial extension of the lip 88 can be different than the radial extension of the tabs 68 so that the tabs 68 and lip 88 are easily distinguishable.

The tabs 68 can be positioned at circumferential positions that correspond to other portions of the connector. For example, as shown in FIG. 3, the tabs 68 can extend radially inward from positions on the sleeve 42 that are disposed 180 degrees apart, and the position of each tab 68 can be longitudinally aligned with the first portion 58 of each slot 56. Thus, a user can use the tabs 68 to determine the rotational orientation of the plug connector 12 in order to properly align the slots 56 with the posts 28 during connection. Further, after the connection is made, the user can verify that the connectors are fully engaged by inspecting the position of the tabs 68.

The tabs 68 and the contrast member 70 are typically characterized by dissimilar colors so that the tabs 68 can be easily viewed against the background of the contrast member 70 and the position of the tabs 68 can be easily determined. In this regard, the sleeve 42 and tabs 68 are typically formed of metal and have a metal color, i.e., a grey or silver color. The contrast member 70 can define a non-metal color, i.e., a color other than grey or silver. In particular, the contrast member 70 can defines colors such as black, red, green, blue, yellow, purple, or orange. The color of the contrast member 70 can be provided by painting, anodizing, or otherwise partially coloring the contrast member 70. Alternatively, the contrast member 70 can be formed of a material that is colored throughout, such as a colored plastic, or the contrast member 70 can be a metal color and the tabs 68 can be one of the non-metal colors. In some cases, the contrast between the colors of the contrast member 70 and the tabs 68 can be significantly greater than the contrast between two metal colored objects, and the contrast can enable a user to easily determine the position of the tabs 68 quickly and easily, even under low-light conditions or other conditions that hinder visual inspection of the connectors.

In some cases, a plurality of the plug connectors 12 can be used to provide a plurality of connections with jack connectors 14 disposed on a panel. In this regard, FIG. 8 illustrates a panel 90 having 36 jack connectors 14 with 35 plug connectors 12 connected thereto. It is appreciated that any number of the connectors 12, 14 can be used on a panel, and the connectors 12, 14 can be configured in other ways. In the illustrated embodiment, the jack connectors 14 are fixed on the panel 90, e.g., by disposing the threaded portion 40 through holes in the panel 90 with the nuts 38 disposed on either side of the panel 90 to secure the jack connectors 14 thereto, and the jack connectors 14 are arranged so that the posts 28 of each connector are aligned vertically. A user can engage a plug connector 12 with one of the jack members 16 of the jack connectors 14 by advancing the plug connector 12 onto the jack member 16 so that the jack member 16 is inserted into the first end 44 of the sleeve 42 of the plug connector 12. In FIG. 8, one of the plug connectors 12 (in the bottom row and fifth column) is illustrated in a disengaged configuration with the tabs 68 aligned vertically, and the other 34 plug connectors 12 are illustrated in the engaged positions. For purposes of illustrative clarity, the cables extending from each of the plug and jack connectors 12, 14 are not shown in FIG. 8.

The plug connector 12 can be aligned with the jack member 16 by inspecting the position of the tabs 68 and rotationally orienting the plug connector 12 so that the tabs 68 are arranged in a configuration (vertical as shown in FIG. 8) that corresponds to the arrangement of the posts 28. As described above, the jack member 16 is engaged with the plug member 50 by inserting the posts 28 into the slots 56 and rotating the sleeve 42 relative to the jack member 16 until the posts 28 are disposed in the detents 62. The proper relative rotation and, hence, the engagement of the connectors 12, 14, can be verified by inspecting the tabs 68 and verifying that each tab 68 is rotated to a predetermined position. In the embodiment of FIG. 8, the plug connectors 12 are fully engaged when the tabs 68 are aligned horizontally. Thus, it will be appreciated that a user can easily scan a large panel 90 of the connectors 12, 14 and quickly determine if any of the sleeves 42 is not fully rotated to engage the plug connector 12 to the respective jack connector 14. Further, the contrast between the color of the contrast member 70 and the tabs 68 allows such inspection to be performed even in low light conditions or other situations where non-contrasting members cannot be distinguished.

It is further appreciated that various colors can be used for the contrast member 70s. For example, each of the contrast members 70 of a plurality of plug connectors 12 can be different, or multiple pluralities of plug connectors 12 having different colors can be used. In this way, the color of the contrast member 70 can additionally indicate an identification of the connector 12. For example, a particular color can indicate that the connector 12 is attached to a particular type of electrical equipment, or a particular color can indicate that the connector 12 is associated with (or distinguished from) other connectors 12, 14. In some cases, the jack connectors 14 can also define colors that correspond to the colors of the plug connectors 12 to facilitate the connection of various plug connectors 12 with various jack connectors 14, such as when connecting the plug and jack connectors 12, 14 shown in FIG. 8.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A BNC plug connector for engaging a BNC jack member and indicating a rotational position of the plug connector, the plug connector comprising:

a sleeve extending longitudinally between first and second ends and defining a first aperture at the first end for receiving a jack member, a second aperture at the second end, and one or more slots extending from the first end toward the second end and configured to receive radial posts extending radially from the jack member;

a plug member disposed in the sleeve and configured to engage the jack member; and a contrast surface at the second end, wherein the sleeve defines at least one feature at the second end extending radially inward to a radial position coincident with the contrast surface, the feature defining a color dissimilar to the contrast surface such that the position of the feature is visible from the second end of the sleeve and the position of the feature is indicative of a rotational position of the sleeve, and said at least one feature is a tab formed as an integral part of the sleeve and extending radially inward into the second aperture at the second end of the sleeve.

2. A BNC plug connector according to claim 1 wherein the sleeve defines two of the features, the two features extending radially inward from positions on the sleeve disposed 180 degrees apart.

3. A BNC plug connector according to claim 1 wherein the contrast surface defines a non-metal color and each feature defines a metal color.

4. A BNC plug connector according to claim 1 wherein the contrast surface defines at least one of the colors consisting of black, red, green, blue, yellow, purple, and orange.

5. A BNC plug connector according to claim 1 wherein the contrast surface is defined by a contrast member disposed in the sleeve at the second end, the contrast member defining a surface visible through the second aperture.

6. A BNC plug connector according to claim 5 wherein the contrast member is a washer defining first and second parallel sides and an aperture extending therethrough, the washer being at least partially retained in the sleeve by the at least one feature.

7. A BNC plug connector according to claim 6 wherein each tab defines a first side and a second side and the sleeve defines a relief cutout adjacent each side of each tab, each tab defining a bend from which the tab extends radially inward between the relief cutouts.

8. A BNC plug connector according to claim 7 wherein each tab is bent to an angle of approximately 90 degrees or less.

9. A BNC plug connector according to claim 7 wherein the sleeve defines two of the tabs, each relief cutout defining a continuously curved contour between the bend of a respective one of the tabs to a circumferential ridge of the sleeve extending between two of the relief cutouts.

10. A method of engaging a BNC plug connector to a BNC jack member and indicating a rotational position of the plug connector, the method comprising:

inserting the jack member into a first end of a sleeve of the plug connector such that the jack member is engaged with a plug member disposed in the sleeve and radial posts of the jack member are disposed in slots extending from the first end of the sleeve toward an opposite second end of the sleeve; and rotating the sleeve relative to the jack member such that at least one feature defined by the sleeve at the second end and extending radially inward to a position coincident with a contrast surface rotates relative to the jack member, said at least one feature defining a color dissimilar to the contrast surface at the second end of the sleeve such that the position of the feature is visible from the second end of the sleeve and the position of the feature is indicative of a rotational position of the sleeve relative to the jack member, wherein the at least one feature is a tab formed as an integral part of the sleeve and extends radially inwardly into an aperture formed at the second end of the sleeve.

11. A method according to claim 10, further comprising providing two of the features on the sleeve, the two features extending radially inward from positions on the sleeve disposed 180 degrees apart.

12. A method according to claim 10, further comprising providing a contrast member defining the contrast surface, the contrast member being disposed in the sleeve at the second end and defining a surface visible through an aperture at the second end of the sleeve, and providing each feature as a tab formed as an integral part of the sleeve and extending radially inward into the aperture at the second end of the sleeve.

13. A method according to claim 12 wherein the contrast member is provided as a washer defining first and second parallel sides and an aperture extending therethrough, the washer being at least partially retained in the sleeve by the at least one tab.

14. A method according to claim 12 wherein said providing steps comprise providing the contrast member defining a non-metal color and providing each tab defining a metal color.

15. A method according to claim 12 wherein the contrast member is provided to define at least one of the colors consisting of black, red, green, blue, yellow, purple, and orange.

16. A method according to claim 12, further comprising providing each tab defining a first side and a second side and the sleeve defining a relief cutout adjacent each side of each tab, each tab defining a bend of up to approximately 90 degrees between the relief cutouts.

17. A method according to claim 12, further comprising inserting the contrast member into the sleeve from the second end of the sleeve and, thereafter, bending each tab into the aperture at the second end of the sleeve.

18. A plug connector for engaging a jack member and indicating a rotational position of the plug connector, the plug connector comprising:

a sleeve extending longitudinally between first and second ends and defining a first aperture at the first end for receiving a jack member, a second aperture at the second end, and one or more slots extending from the first end toward the second end and configured to receive radial posts extending radially from the jack member; and a plug member disposed in the sleeve and configured to engage the jack member, wherein a tab is formed as an integral part of the sleeve, said tab being positioned at the second end of the sleeve and extending radially inwardly into the second aperture.

19. The plug connector of claim 18, further comprising a contrast surface at the second end, wherein a portion of the contrast surface is positioned between the first end of the sleeve and the tab, and the tab has a color that is different than the color of the contrast portion such that the position of the tab is visible from the second end of the sleeve and the position of the tab is indicative of a rotational position of the sleeve.

20. The plug connector of claim 18, wherein the tab defines a first side and a second side and the sleeve defines a relief cutout adjacent each side of the tab, the tab defining a bend from which the tab extends radially inward between the relief cutouts.

* * * * *